US005199117A

United States Patent [19]

Hintz

[11] Patent Number: 5,199,117

[45] Date of Patent: Apr. 6, 1993

[54] SEAT ATTACHMENT SYSTEM

[75] Inventor: Jonathan M. Hintz, Sheboygan Falls, Wis.

[73] Assignee: Kohler Co., Kohler, Wis.

[21] Appl. No.: 823,796

[22] Filed: Jan. 22, 1992

[51] Int. Cl.[5] ..... A47K 3/12

[52] U.S. Cl. ..... 4/590; 403/7

[58] Field of Search ..... 4/541.1, 578.1, 579, 4/584, 589, 590, 541.2, 541.3, 541.4, 541.5; 297/188; 403/6, 7, 8

[56] References Cited

U.S. PATENT DOCUMENTS

| | | | |
|---|---|---|---|
| 1,844,988 | 2/1932 | Steinkamp | 4/590 |
| 1,940,514 | 12/1933 | Steinkamp | 4/590 |
| 3,063,523 | 11/1962 | Triplett | 403/8 X |
| 3,159,849 | 12/1964 | Jacuzzi | 4/541.3 |
| 3,285,635 | 11/1966 | Whelan | 403/8 X |
| 3,297,025 | 1/1967 | Jacuzzi | 4/541.4 X |
| 3,370,001 | 3/1986 | Kelley | 4/579 |
| 3,396,412 | 8/1968 | Francom | 4/541.4 |
| 3,420,226 | 1/1969 | Berry, Jr. | 4/541.3 X |
| 4,552,658 | 11/1985 | Adcock et al. | 4/541.3 |
| 4,607,972 | 8/1986 | Hennick | 403/8 |
| 4,637,589 | 1/1987 | Lin | 403/8 X |

FOREIGN PATENT DOCUMENTS

| | | | |
|---|---|---|---|
| 0301391 | 11/1954 | Switzerland | 403/8 |
| 0931754 | 7/1963 | United Kingdom | 4/584 |

*Primary Examiner*—William A. Cuchlinski, Jr.
*Assistant Examiner*—John L. Beres
*Attorney, Agent, or Firm*—Quarles & Brady

[57] ABSTRACT

Disclosed herein is an apparatus for providing a comfortable and esthetically pleasing seat in a whirlpool tub enclosure in which the seat doubles as a removable cover to allow access to the pump. The invention lies in the structure of the seat in which an indentation in the seat's side edge permits a bolt to be retained by a nut. The attachment can be secured below the surface of the seat to provide a comfortable sitting surface, while allowing access to the whirlpool mechanism when needed.

9 Claims, 2 Drawing Sheets

SEAT ATTACHMENT SYSTEM

BACKGROUND OF THE INVENTION

1. Field Of The Invention

This invention relates to whirlpool foot baths and the like where means are provided to removably attach a seat to a compartment adjacent to the foot bath.

2. Description Of The Art

Whirlpool foot baths, sometimes as part of a shower enclosure, are available to enable a user to soak and relax his or her feet. Such a fixture typically includes an electrically powered pump adjacent to the basin. The pump must be accessible for maintenance, adjustment and repair, and must be secured from water that is in the tub basin. Access to such pump can be provided through a room wall from an adjacent closet, crawl space or other unobtrusive area. This allows the shower enclosure to remain a one piece, sealed shell. However, in some cases there is no such convenient adjacent access space.

A more satisfactory solution of the access problem is to design the enclosure so that the bather's seat in the whirlpool doubles as a removable cover for the compartment containing the pump, thereby providing access to the pump from inside the enclosure.

Using the seat as the compartment cover requires the solution of a number of problems. The seat/cover must prevent splashed water from leaking into the pump compartment. It also requires that the seat/cover be securely attached in a way that does not interfere with the utility of the seat. While attaching the seat/cover to the compartment by a bolt, washer, and nut can provide a waterproof seal, it may subject the bather to discomfort if the bolt head intrudes upon the sitting surface. Countersinking the nuts or bolts would prevent discomfort to a bather. However, countersunk holes are undesirable esthetically from the outset, and their esthetics worsen as water and dirt and mold collect in and around them.

SUMMARY OF THE INVENTION

In one aspect, the invention provides a seating system which includes a plate having an upper seating surface, a lower surface and a side peripheral edge generally perpendicular to the upper and lower surfaces. At one or more locations along its side peripheral edge, an indentation is provided in that edge. Each such indentation is open to the edge, and has a ceiling and a floor. The floor has a passageway extending from the indentation to the lower surface of the seat. This passageway accommodates a fastener. From the side, the indentation accepts a fastener retainer in alignment with the passageway. If needed, a tool, such as a wrench, can reach the fastener retainer from the open edge of the indentation. The fastener retainer secures the seat without protruding into the seating surface.

Another aspect of the invention is the use of the apparatus described above in providing a whirlpool tub in which the user's seat doubles as the cover for the compartment housing the whirlpool mechanism.

It will be appreciated that the invention provides an improved apparatus for mounting a seat or a cover where it is desirable to avoid intrusion of the mounting means into the top surface of the seat or cover. At whatever point or points on the edge of the seat/cover where this apparatus and method is used, mounting (including the use of a tool such as a wrench) can be accomplished entirely from the edge. The mounting means, such as a bolt or a nut, are hidden from normal view and cannot be felt at the top surface of the seat/cover.

It is an object of the invention to provide a whirlpool-bath seat which doubles as a cover for the compartment which houses the pump or other apparatus which produces the whirlpool action in the tub. The invention facilitates access to the whirlpool apparatus within the tub, provides a secure cover for the compartment, and avoids protrusions on the surface of the seat which would diminish its ability to function as a seat and which would become an eye sore as a result of collected water, dirt and mold.

These and other objects and advantages of the invention will be apparent from the description which follows. The preferred embodiment will be described in reference to the accompanying drawings. This embodiment does not represent the full scope of the invention, but rather the invention may be employed in other embodiments. Reference should therefore be made to the claims herein for interpreting the breadth of the invention.

DESCRIPTION OF THE PREFERRED EMBODIMENT

Figure 1:
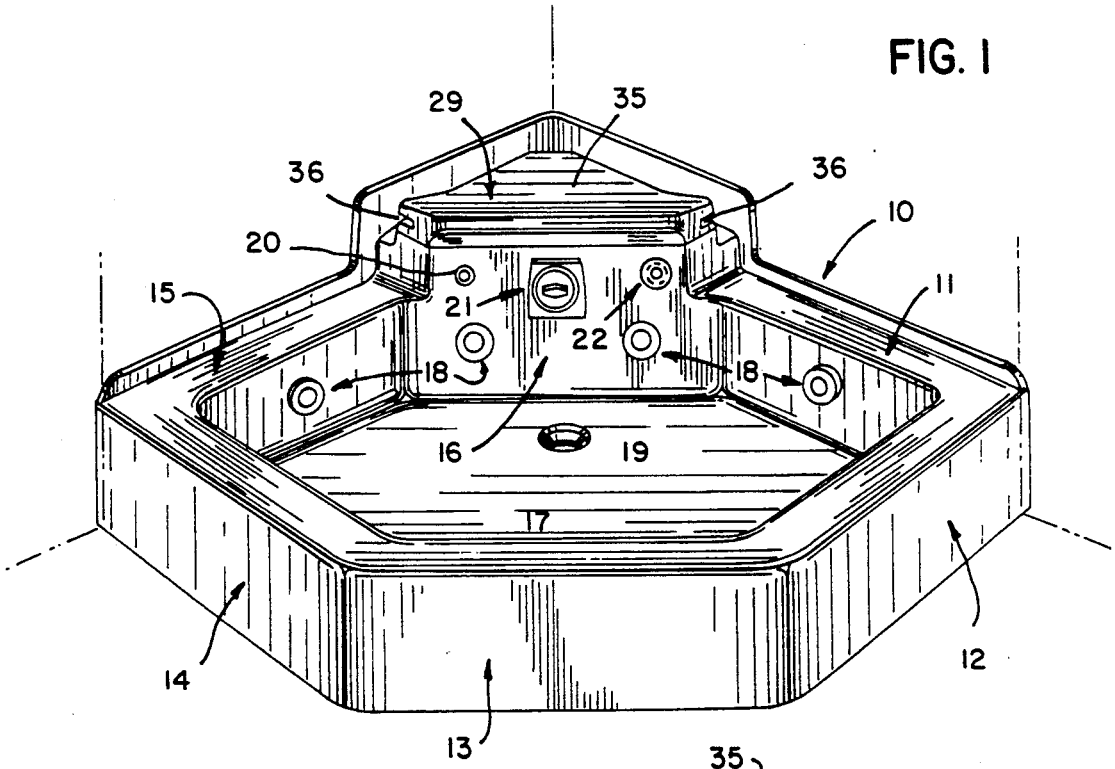
FIG. 1 is a perspective view, from the front and the top, of a whirlpool foot bath mounted in the corner of a room.

Referring to FIG. 1, tub 10 has side walls 11, 12, 13, 14, 15 and 16 which, with bottom 17, provide a tub for a foot bath. This is preferably formed in a one piece molded plastic construction. There are whirlpool jet outlets 18 in walls 11, 15 and 16 and a drain in bottom 17. Wall 16 has a start-stop button 20, an overflow drain 21 and an air inlet 22.

Figure 2:
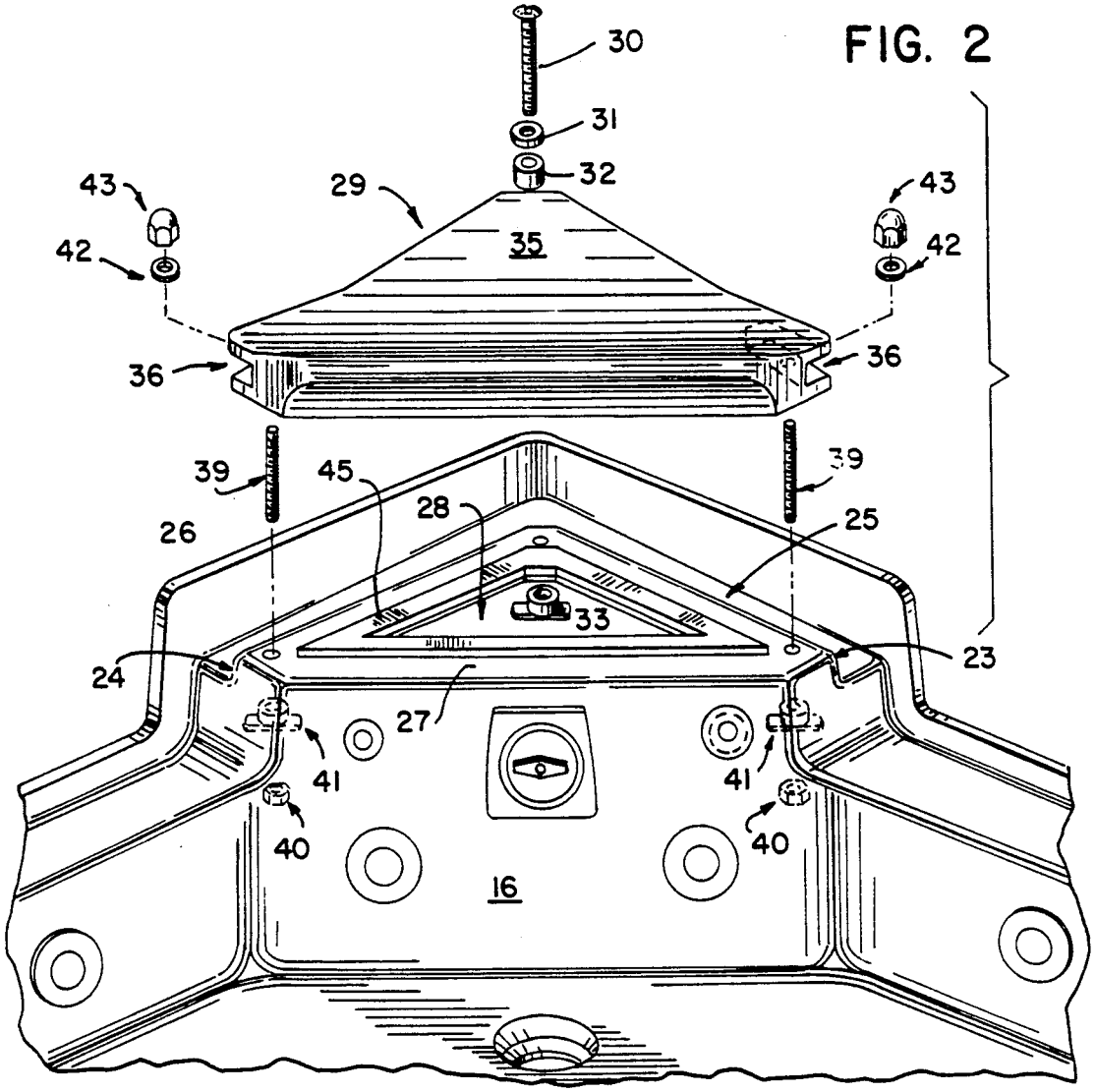
FIG. 2 is an enlarged and exploded view of a portion of the whirlpool foot bath of FIG. 1 containing a seat.

Referring specifically to FIG. 2, the seat pedestal portion includes side wall 16 (which is higher than side walls 11, 12, 13, 14 and 15) and walls 23 and 24 which are raised above channels 25 and 26. These walls form the surface of pedestal 27 whose triangular shape defines the opening to whirlpool mechanism compartment 28. A pump (not shown) and drain control linkage (not shown) can be housed in compartment 28.

Figure 5:
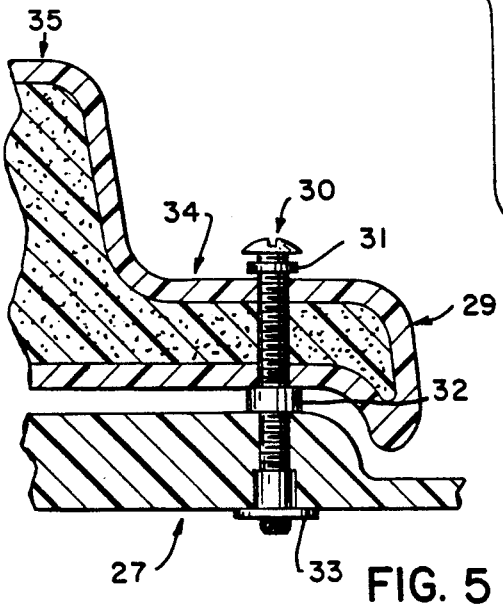
FIG. 5 is an elevational cross-sectional view of the rear part of the seat of FIG. 2.

Still referring to FIG. 2, seat 29 is poised over and about to be mounted on pedestal 27. As shown in FIG. 5, mounting of the seat in the rear is accomplished by bolt 30, washer 31, screw gasket 32 and T-nut 33. Note that mounting bolt 30 and screw gasket 31 protrude through rear mounting surface 34. However, rear mounting surface 34 is lower than sitting surface 35 and is located in a corner out of easy view of an observer and well behind where a user will normally sit.

Figure 4:
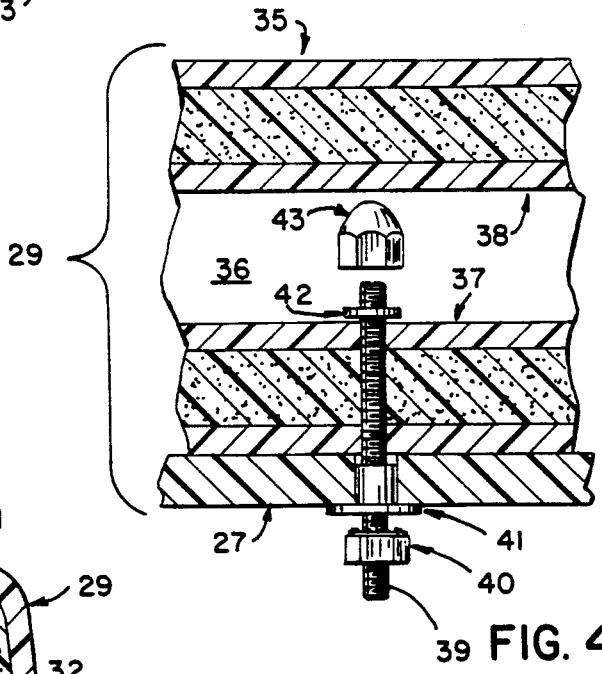
FIG. 4 is an elevational cross-sectional view of a portion of the edge of the seat of FIG. 2 about to be fastened to the pedestal of the whirlpool foot bath by means of a nut and bolt.

As shown in FIGS. 2 and 4, at both of the two front mounting points there is a side indentation 36 in the edge of seat 29. The indentation has a floor 37 and a ceiling 38. In FIG. 4, threaded shaft 39 has been inserted upward through pedestal 27 and through floor 37 so as to project halfway into indentation 36. Mounted on threaded shafts 39 below pedestal 27 are lock nuts 40 and T-nuts 41. Also mounted on threaded shaft 39 in the indentation is washer 42. Acorn nut 43 is screwed onto threaded shaft 39 as more fully described below.

Figure 3:
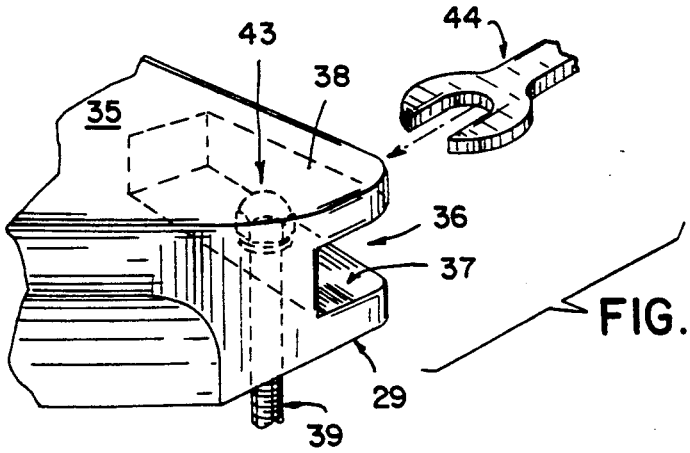
FIG. 3 is an enlarged view of a portion of the edge of the seat of FIG. 2 showing an indentation in the edge in which a wrench is about to attach a nut to a bolt.

FIG. 3 shows the accessibility of acorn nut 43 to wrench 44. Wrench 44 is able to tighten acorn nut 43 from the side because of the resistance provided by lock nut 40 and T-nut 41.

A watertight seal of compartment 28 is achieved with the help of washers and gaskets 31, 32 and 42 and pedestal main gasket 45, which is affixed to seat pedestal 27.

To install seat 29, T-nut 33 is pressed upward into the hole provided therefor at the rear of pedestal 27. Threaded shafts 39 are installed through the bottom of seat pedestal 27 through the holes provided therefor at the front of seat 29, using a T-nut 41 inserted into the under side of pedestal 27 and secured by lock nut 40 with its teeth facing up.

Threaded shaft 39 is installed such that a sufficient length of it extends above pedestal 27 to accommodate seat 29, screw gasket 42 and acorn nut 43. Seat 29 is installed on pedestal 27 so that threaded shafts 39 extend into indentations 36. A screw gasket 42 is inserted at the top of each threaded shaft 39, followed by acorn nut 43, which is tightened from the side by an appropriate tool such as wrench 44. The rear of the seat is secured by inserting bolt 30 downward through screw gasket 31 and through the hole provided in seat 29, screw gasket 32 and the hole provided in pedestal 27. It is then threaded into T-nut 33, using a screw driver applied from the top of the seat assembly.

From the description above, it is apparent that the present invention provides a way to removably attach a seat, without encroaching upon the normally used upper surface of the seat. The invention thus allows the seat for the bather to double as the cover for the compartment housing, while still providing a comfortable seat without protrusions which could be felt by the bather or cause injury.

Although the preferred embodiment of the invention has been described above, the claims are not restricted to that embodiment. There may be various other modifications and changes to the embodiment which are within the spirit of the invention. For example, one front bolt may be sufficient instead of two. Also the rear exposed bolt can be eliminated in some installations. Thus, the invention is not to be limited by the specific description above, but should be judged by the claims which follow.

I claim:

1. A removable seating system which comprises:

(a) a plate having an upper seating surface, a lower surface and a side peripheral edge generally perpendicular to the upper and lower surfaces; and (b) the plate having at least one indentation in its side peripheral edge, which indentation is open to the side peripheral edge and has a ceiling and a floor, the floor having a passageway extending from the indentation to the lower surface, the passageway being disposed to accommodate a fastener and the indentation being such as to permit a fastener retainer to be inserted in the indentation in alignment with the passageway.

2. The seating system of claim 1 further comprising a fastener suitable to pass up through the passageway and a fastener retainer suitable to mate with an end of the fastener when the fastener extends into the indentation from the passageway.

3. The seating system of claim 1, wherein the portion of the upper seating surface that is directly above the junction of the passageway and the indentation has a smooth seating surface.

4. In a whirlpool basin fixture of the type in which a pump is housed in a compartment whose top is an openable cover, the improvement comprising:

(a) a cover plate which is generally planar with an upper seating surface and a lower surface and a side peripheral edge generally perpendicular to the upper and lower surfaces; and (b) the plate having at least one indentation in the peripheral edge, which indentation is open to the side peripheral edge and has a ceiling and a floor, the floor having an opening to a passageway that extends from the floor downward to an opening in the lower surface, the passageway being disposed to accommodate a fastener, and the indentation being such so as to permit a fastener retainer to be inserted into the indentation in alignment with the passageway.

5. The fixture of claim 4, further comprising a fastener suitable to pass up through the passageway and a fastener retainer suitable to mate with an end of the fastener when the fastener extends into the indentation from the passageway.

6. The fixture of claim 5, wherein the portion of the upper seating surface that is directly above the junction of the passageway and the indentation has a smooth seating surface.

7. The fixture of claim 4, wherein gasket means are provided adjacent the cover plate to prevent liquid from flowing downward into the compartment.

8. An improved whirlpool fixture of the type in which a pump is housed in a compartment whose top is an openable cover, wherein the improvement comprises:

(a) a cover which is generally planar with an upper and a lower surface and a peripheral edge generally perpendicular to the upper and lower surfaces, the cover having an indentation in its peripheral edge, which indentation is open to the edge and has a ceiling and a floor, the floor having an opening to a passageway extending from the floor downward through the cover to an opening in the lower surface, (b) a first component of a mounting means for fastening the cover to the compartment which can be disposed in the passageway and, (c) a second component of the mounting means insertable in the indentation which can retain the first component.

9. The fixture of claim 8 wherein a gasket means for preventing liquid from flowing downward along the first component of the mounting means is mounted on that first component between the second component of the mounting means and the floor of the indentation.

* * * * *